US005472187A

United States Patent [19]

Kempf

[11] Patent Number: 5,472,187

[45] Date of Patent: Dec. 5, 1995

[54] BALL PITCH TRAINING DEVICE

[76] Inventor: Cheri K. Kempf, 579 Rural Hill, Nashville, Tenn. 37217

[21] Appl. No.: 386,926

[22] Filed: Feb. 10, 1995

[51] Int. Cl.[6] ..... A63B 69/40

[52] U.S. Cl. ..... 273/26 R; 273/60 R; 273/58 K

[58] Field of Search ..... 273/60 R, 26 B, 273/428, 58 K, 424

[56] References Cited

U.S. PATENT DOCUMENTS

| | | | |
|---|---|---|---|
| 4,128,238 | 12/1978 | Newcomb | 273/58 K |
| 4,616,827 | 10/1986 | Bergland | 273/60 R |
| 4,991,838 | 2/1991 | Groves | 273/60 R |

OTHER PUBLICATIONS

New York Times, Apr. 17, 1978, p. C–14.

*Primary Examiner*—Theatrice Brown

*Attorney, Agent, or Firm*—Waddey & Patterson; I. C. Waddey, Jr.

[57] ABSTRACT

The device of the present invention is substantially disk-shaped having two flat sides lying in parallel planes substantially one-inch apart and a circular profile with a circular perimeter surface connecting the two circular flat sides. The device is molded from a urethane material having a durometer hardness of approximately 60. When used as a training device for softball pitching, the device will have a 12" circumference, a 3.75" diameter, a thickness of 1", a weight of 6.25 ounces and a pair of molded seams on opposite sides of the circular perimeter; two seams being 1.5" apart and two seams being 3" apart.

11 Claims, 2 Drawing Sheets

BALL PITCH TRAINING DEVICE

BACKGROUND OF THE INVENTION

The present invention relates generally to a ball pitch training device and more particularly to a training device designed to facilitate a user learning to make a perfect pitching release and motion so that a ball, when pitched, will have a perfect rotation to achieve maximum velocity and accuracy.

It will be appreciated by those skilled in the art that many sports involve the throwing or pitching of a ball and that in most instances, velocity and accuracy of the pitched ball are desirable skills to be developed by the participants in most of those sports. In particular, baseball and softball are sports which center primarily around pitching a ball with velocity and accuracy. Proper throwing techniques are essential in achieving these desired results. To this end, there have been several attempts to develop devices to assist or facilitate the training of participants in the proper throwing techniques of a baseball or softball. One such device is illustrated in U.S. Pat. No. 4,991,838 issued to Groves on Feb. 12, 1991. Groves contemplates a conventional baseball having a colored, lined marking on the cover, and preferably a red-colored stripe spiraling down from the top of the ball to the bottom. The Groves baseball allows one to follow the rotation of the ball by observing the movement of the colored, lined spiral marker, thus making the flight of the ball easier to follow. By being able to follow the path of the colored, lined marking on the cover, one can observe the efficacy of his/her throw. The Groves device is one attempt to deal with the problem in which Applicant's invention is directed, but the manner in dealing with this problem is altogether different than that adopted by Applicant.

Another device which is somewhat similar in structure to Applicant's device but which is designed for an altogether different purpose is the playing ball described in U.S. Pat. No. 4,616,827 issued to Bergland on Oct. 14, 1986. The Bergland device is a playing ball constructed of a central cylindrical disk and a pair of flanking domed-shaped parabolic portions connected to the cylindrical central disk portion. However, the Bergland device is designed to modify the consequences of using a spherical ball in traditional sports such as baseball or softball and is not designed to function as a training device. Moreover, it would not necessarily function as a training device in the same fashion contemplated by Applicant in her device because the smooth edges of the parabolic surface will not show up as readily as the straight disk-shaped sides of Applicant's device in order to more readily observe whether or not the user has achieved the perfect throwing motion.

What is needed then is a device for training the user to make the perfect throwing motion, thereby increasing his/her ability to throw with accuracy and velocity. Such a device is presently lacking in the prior art.

SUMMARY OF THE INVENTION

The device of the present invention is substantially biscuit-shaped having two flat sides lying in parallel planes substantially one-inch apart and a circular profile with a circular perimeter surface connecting the two circular flat sides. The device is molded from a urethane material having a durometer hardness of approximately 60. When used as a training device for softball pitching, the device will have substantially the following specifications: a 12" circumference, a 3.75" diameter, a thickness of 1", a weight of 185 grams and a pair of molded seams on opposite sides of the circular perimeter; two seams being 1.5" apart and two seams being 3" apart.

When used as a training device for teaching one to throw a baseball properly, the device will have substantially the following specifications: a 9" circumference, a thickness of ¾", and a weight of 5 ounces.

When used as a training device for demonstrating the proper technique for shooting a basketball, the device will have a circumference substantially equal to that of a regulation basketball, a thickness of approximately 3" and a weight substantially equal to that of a regulation basketball. Instead of having seams on opposite sides of the device, the basketball training device will have indented seams periodically around its circumference.

DESCRIPTION OF THE PREFERRED EMBODIMENT

Figure 1:
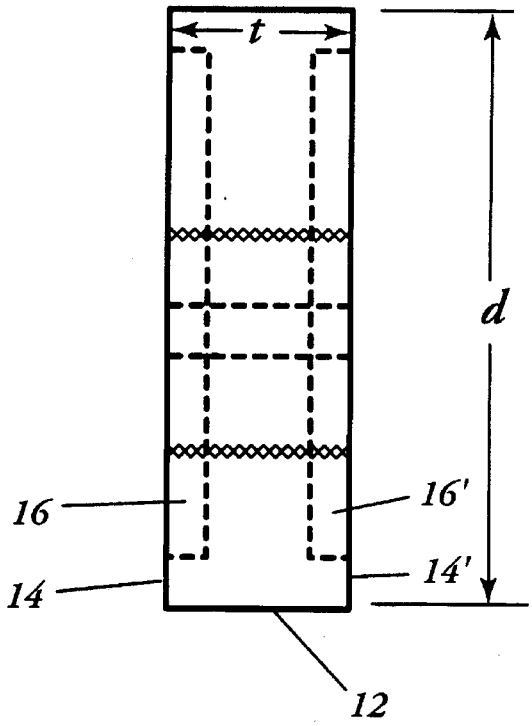
FIG. 1 is a frontal view of the device of the present invention.
Figure 2:
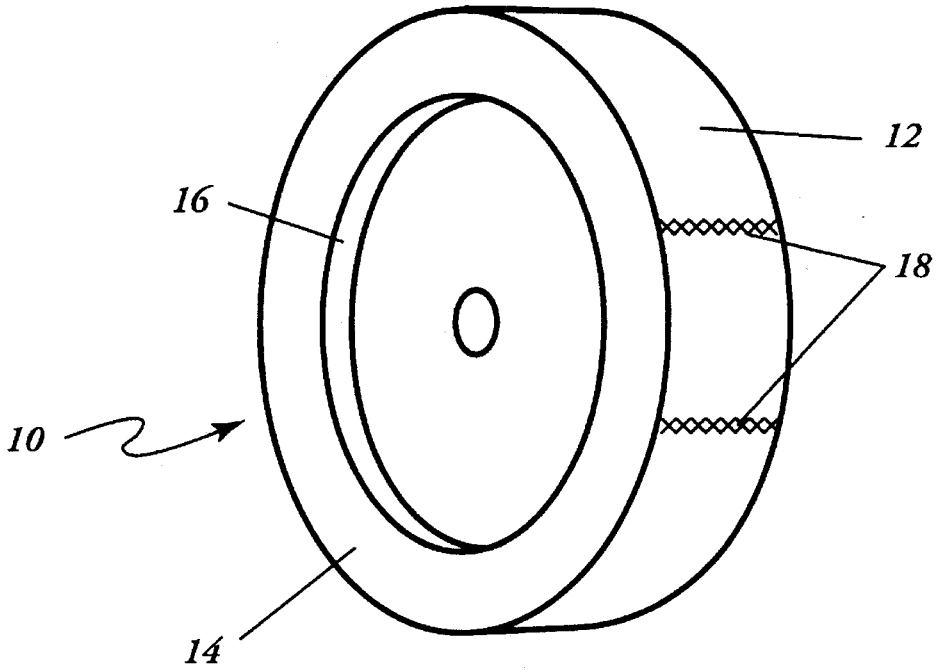
FIG. 2 is a perspective side view of the device of the present invention.

The device of the present invention has the shape of a biscuit or an automobile fire. The present invention is shown in FIG. 1 generally at 10. The device 10 has a circular perimeter 12 and flat sides 14, 14'. Looking at the device straight on as shown in FIG. 1, it has a rectangular shape with a thickness t and a diameter d. Looking at the device 10 from the side or profile view, as is shown in FIG. 2, the device is circular in shape. Counter-bores 16, 16' can be cut into the flat sides 14, 14'. The counter-bores 16, 16' create recesses on each side of the device 10. The recesses are designed to receive logo or tradename identification panels glued or otherwise fixed therein. The logo or tradename identification panels placed in the recesses created by the counter-bores 16, 16' will not be subject to the same wear and tear that would otherwise be the case if they were on the outside flat surfaces of the device. Further, the counter-bores 16, 16' can be used to adjust the weight of the device in order to achieve accurate weight as desired.

On the circular perimeter of the device 10 are two sets of threads 18. When the device is configured for use in training softball pitchers, the two sets of threads 18 are on diametrically opposite sides of the device 10 and the threads of one set of threads are spaced approximately 1.5" apart and the threads of the second set of threads are spaced approximately 3" apart. When the device is configured to train baseball and softball players, the threads are molded seams which are raised from the circular perimeter 12 and extend radially outwardly of the device. When the device is configured to train one to have the proper shooting motion for shooting a basketball, the threads 18 are equally spaced about the circular perimeter and are recessed, extending radially inwardly from the circular perimeter.

When the device is configured for training persons for slow-pitch and youth softball, its specifications are substantially as follows: the thickness t is 1", the perimeter is 11" and the diameter is substantially 3.5" and the weight is 164 grams.

When the device 10 is configured to train persons in the proper throwing of a softball for fast-pitch competition, its specifications are substantially as follows: the thickness of the device t is 1", the diameter is substantially 3.75" and the weight is 185 grams.

When the device 10 is configured to train one in the proper pitching of a baseball, its specifications are substantially as follows: the thickness t is preferably substantially ¾", the circumference is 9" and the weight is substantially 5 oz.

When configured to train one in the proper shooting technique for shooting a basketball, the specifications of the device for a women's basketball are substantially as follows: the device has a thickness t of approximately 3", a circumference of approximately 28.5–29", and weight of substantially 18–20 ounces.

When configured to train one in the proper shooting technique for shooting a basketball, the specifications of the device for a men's basketball are substantially as follows: the device has a thickness t of approximately 3", a circumference of approximately 29.5–30", and weight of substantially 20–22 ounces.

In each of the devices, regardless of configuration, the construction is of a urethane or other similar material having a durometer measure of hardness of approximately 60.

Figure 3:
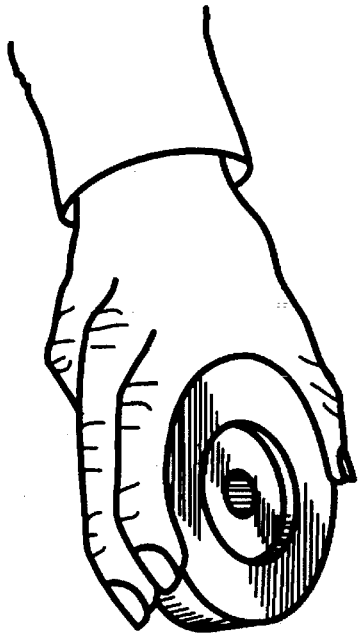
FIG. 3 shows the two-fingered grip of the present invention.
Figure 4:
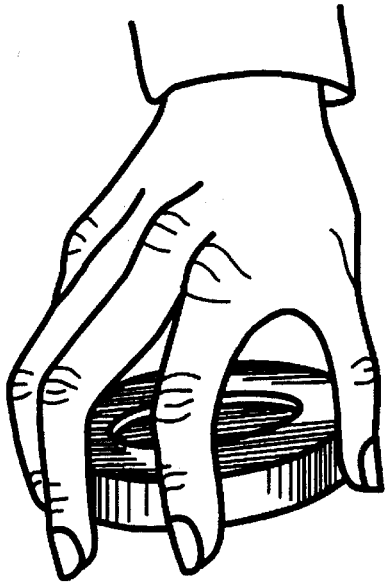
FIG. 4 shows a cross grip of the device of the present invention.

In use, one of the primary functions of the device is to train participants to make a proper "12 to 6" throwing motion. The "12 to 6" throwing motion is the term used to describe a motion, when viewed in profile, that occurs when a player properly throws a pitch overhanded and his/her arm makes the movement of a clock hand moving from the 12 o'clock position to the 6 o'clock position. With the proper "12 to 6" throwing motion, if the training device of the present invention is gripped with the two-finger grip as shown in FIG. 3 and the training device 10 is released so that it rolls off of the tip of the index and middle, the device will have a backward spin and will move through the air in a substantially vertical plane without any side to side wobble. If the throw is in a side-arm fashion or a ¾-arm fashion, the device will lie in a plane at an angle to the vertical and its velocity will be reduced, particularly if the device is not released correctly so that it has a side to side wobble.

Any side to side wobble employs energy that could otherwise be used to propel the device at maximum velocity. Further, when the device is thrown in a side-arm or a ¾-arm movement rather than in the desired "12 to 6" movement, the accuracy of the throw can be impaired. Depending upon the point in which the device is actually released, the device may go to one side or the other of the target, usually a receiving "catcher" of the device. When the device is thrown in the perfect "12 to 6" motion, the device will go directly toward its target, thus improving the pitcher's accuracy. While the device may be too high or too low, a problem which can also occur in connection with a side-arm or a ¾-arm throwing motion, the device will not be off target from side to side when properly thrown.

In practice, the device can be thrown against a solid wall and if properly thrown, because of the vertical orientation of the device as it passes through the air and its spinning motion in a single vertical plane, when the device hits the wall, it will bounce back to the thrower and continued repeated practice can be employed to perfect the throwing motion. When the device is released improperly, it will wobble from side to side and when the device hits the wall, it may hit on the edge and careen in an angular direction or it may drop straight to the ground, but in any event, in most instances, it will not return to the thrower. Thus, the training device provides instant gratification when the device is properly thrown, using the proper throwing motion, and likewise, there is instant rejection when improper throwing motion is employed.

A similar use of the device is required when training someone to make a softball, or underhanded throw. Once again, the preferred throwing motion is a "12 to 6" motion when viewed in profile, but this time, the movement of the arm is counter-clockwise and the release is at the approximately 6 o'clock position rather than approximately at the position of 2 o'clock as is the case in an overhand throw. For training in connection with a softball pitch, once again, the two-fingered grip as showing in FIG. 3 is used, but the palm of the hand faces the batter for a normal "fast ball" throw and the device is released by rolling it off of the middle and index finger. The device will then have a forward spin and will be vertically aligned. When the device is thrown properly, it will spin in a single plane and will not wobble from side to side. Once again, when thrown against the wall or other hard surface, if properly thrown, the device will bounce back to the thrower, but if it is improperly thrown and is wobbling from side to side when it hits the wall, it will careen from side to side or will drop straight down. In any event, it will not return true to form to the thrower as in the situation where a proper throw is made.

When used to train one in the proper shooting technique for shooting a basketball, the device 10 is propelled by extending the arm in a shooting motion and releasing the wrist at the last moment. The device, when configured to train one in the proper techniques for shooting a basketball, has a thickness of approximately 3", therefore, the ring finger, middle finger and index finger will be placed on the circular perimeter and the shot will release from those three fingers. If properly shot, the device will have a perfect reverse spin rotation on it and that rotation will be apparent from observing the device as it travels through the air. Further, if the device is properly shot, it will rotate in the same plane and will not wobble from side to side. On the other hand, if an improper shooting motion is employed, the device will roll off of either an inside finger or an outside finger and then tend to wobble back and forth rather than rotate in a single plane. At that point, the shooter can observe clearly that an improper shooting motion has been employed.

The device can also be used to teach the proper throw of softball and baseball pitches described as drops, change-ups, curves, and rise balls. In each instance, the objective is to secure a release of the device so that it rotates in a single plane and the person using the device can see immediately if the device has been improperly released because it will then wobble from side to side rather than rotate in a single plane. Training to throw these pitches often times is where injuries occur from mistakes in the understanding of spins. The invention significantly reduces the opportunity for misunderstandings.

Thus, although there have been described particular embodiments of the present invention of a new and useful ball pitch training device, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What I claim is:

1. A device for use in training a person to make a proper throwing motion when throwing a ball, said device being substantially disk shaped, said device having two flat sides lying in parallel planes and spaced apart by a thickness in the range of substantially ¾ to 3", said flat sides being circular when the device is being viewed from the side, said flat sides being connected by a circular perimeter, the circular perimeter having a circumference and a weight substantially equal to the circumference and weight respectively of a ball selected from the group consisting of a Little League baseball, a Major League baseball, an Amateur Softball Association of America Official Slow Pitch Softball, an Amateur Softball Association of America Official Fast Pitch Softball, a United States Slow Pitch Softball Association Official Slow Pitch Softball, a United States Slow Pitch Softball Association Official Fast Pitch Softball, a National Collegiate Athletic Association Official Women's Basketball, a National Collegiate Athletic Association Official Men's Basketball, and a National Basketball Official Basketball.

2. The device of claim 1 wherein the thickness of the device is substantially ¾, and the device has a diameter and weight substantially equal to the diameter and weight of a Major League Baseball official baseball.

3. The device of claim 1 wherein the device has a thickness of approximately 1" and a circumference of substantially 11" and a weight of substantially 6 ounces.

4. The device of claim 1 wherein the device has a thickness of substantially 1", a circumference of substantially 12" and a weight of substantially 6.25 ounces.

5. The device of claim 1 wherein the thickness is substantially 3", the circumference is substantially in the range of 28.5–30" and the weight is substantially in the range of 18–22 ounces.

6. The device of claim 1 further including a counter-bore in each side of the device creating a circular recess in the sides of the device designed to accept an imprinted logo or other identifying materials.

7. The device of claim 1 further including seams molded in the circular perimeter, said seams extending between the flat sides of the device and substantially perpendicular to the flat sides of the device.

8. The device of claim 7 wherein there are two sets of seams, each set consisting of two seams each, with one set being diametrically opposite from the other set.

9. The device of claim 8 wherein the seams of one set of seams are separated by substantially 1.5" and the seams of the other set of seams are separated by substantially 3".

10. The device of claim 1 being constructed of a material having a durometer measured hardness of substantially 60.

11. The device of claim 1 wherein said device is constructed from a urethane material.

* * * * *